US006749143B1

(12) United States Patent
Holcomb

(10) Patent No.: US 6,749,143 B1
(45) Date of Patent: Jun. 15, 2004

(54) LEVEL WINDING DEVICE

(76) Inventor: Jimmy F. Holcomb, Rt. 1, Box 37B, Liemoris, WV (US) 25125

( * ) Notice: Subject to any disclaimer, the term of this patent is extended or adjusted under 35 U.S.C. 154(b) by 273 days.

(21) Appl. No.: 09/803,720

(22) Filed: Mar. 12, 2001

Related U.S. Application Data

(60) Provisional application No. 60/190,922, filed on Mar. 21, 2000.

(51) Int. Cl.[7] ..... B65H 27/00
(52) U.S. Cl. ..... 242/397.3
(58) Field of Search ..... 242/397.3, 277

(56) References Cited

U.S. PATENT DOCUMENTS 1,507,404 A * 9/1924 Welch ..... 242/277
5,033,692 A 7/1991 Holcomb ..... 242/158.3
5,141,172 A 8/1992 Holcomb ..... 242/158.3

* cited by examiner

*Primary Examiner*—John Q. Nguyen
(74) *Attorney, Agent, or Firm*—Jim Zegeer

(57) ABSTRACT

A reel winding device for heavy-duty cables, hoses and the like in which the input shaft is extended through both sides of the housing so that the device can be used on left-handed and right-handed inputs and avoids the necessity of having to inventory both types of input devices. Moreover, the cable to guide the output arm has been centered with the device, and the device has been made more compact by cutting the gear teeth in the input shaft, one of the gear teeth in the input shaft and one of the gear teeth in the countershaft.

3 Claims, 4 Drawing Sheets

LEVEL WINDING DEVICE

REFERENCE TO RELATED APPLICATIONS

The present application is the subject of provisional application No. 60/190,922 filed Mar. 21, 2000 for LEVEL WINDING DEVICE.

BACKGROUND AND BRIEF DESCRIPTION OF THE INVENTION

Level winding devices are well known in the art as is shown in my U.S. Pat. No. 5,141,172 and No. 5,033,692, both of which are incorporated herein by reference.

The present invention is an improvement over these devices as well as other devices commercially available in the art in that the input shaft is extended through both sides of the housing so that the device can be used on left-handed and right-handed inputs and avoids the necessity of having to inventory both types of input devices. Moreover, the device has been made more compact and the cable guide output arm has been centered with the device.

The object of the invention is to provide an improved reel level winding device and more particularly to provide an improved level winding device which can be driven from each side, is more compact, and in which the cable guide oscillating arm is center-mounted.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
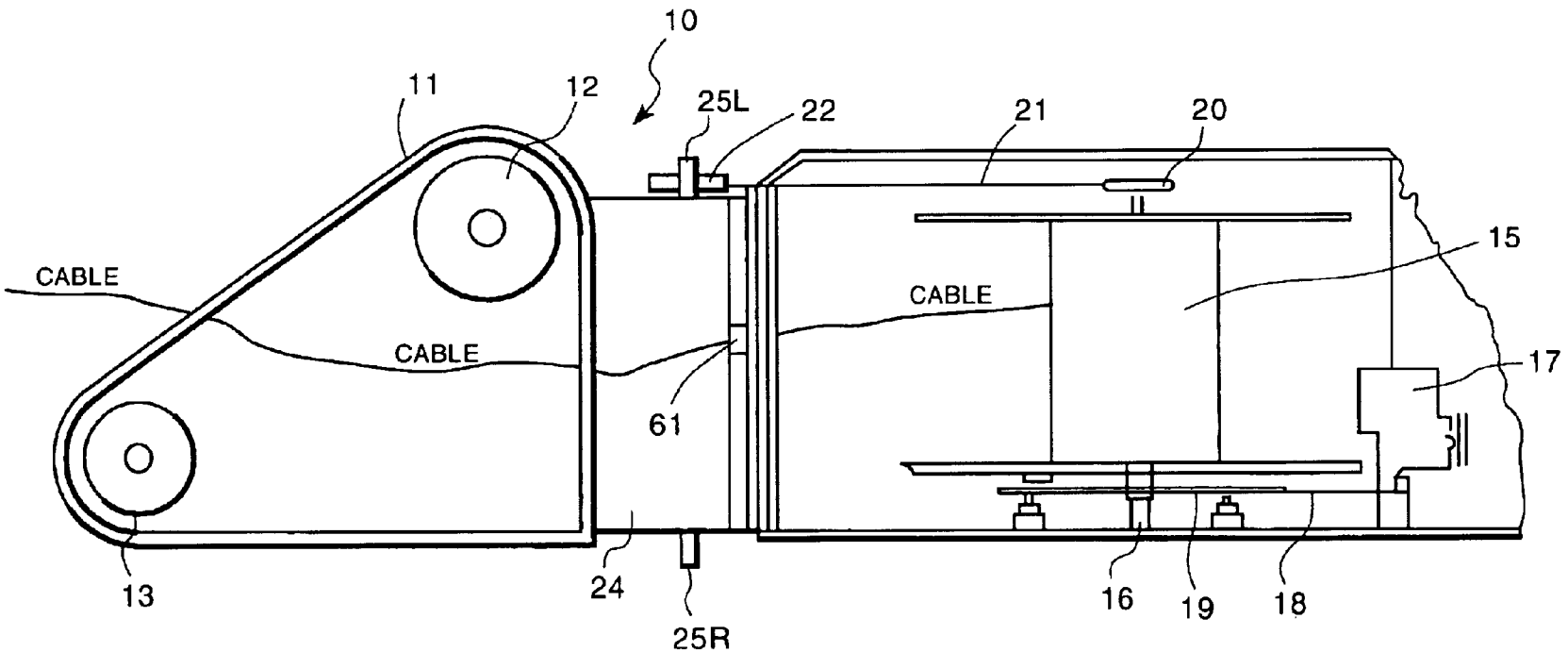
FIG. 1 is a top plan view of a portion of a mobile mine equipment on which the invention is installed and which the equipment can move backward, to the right and to the left.
Figure 2:
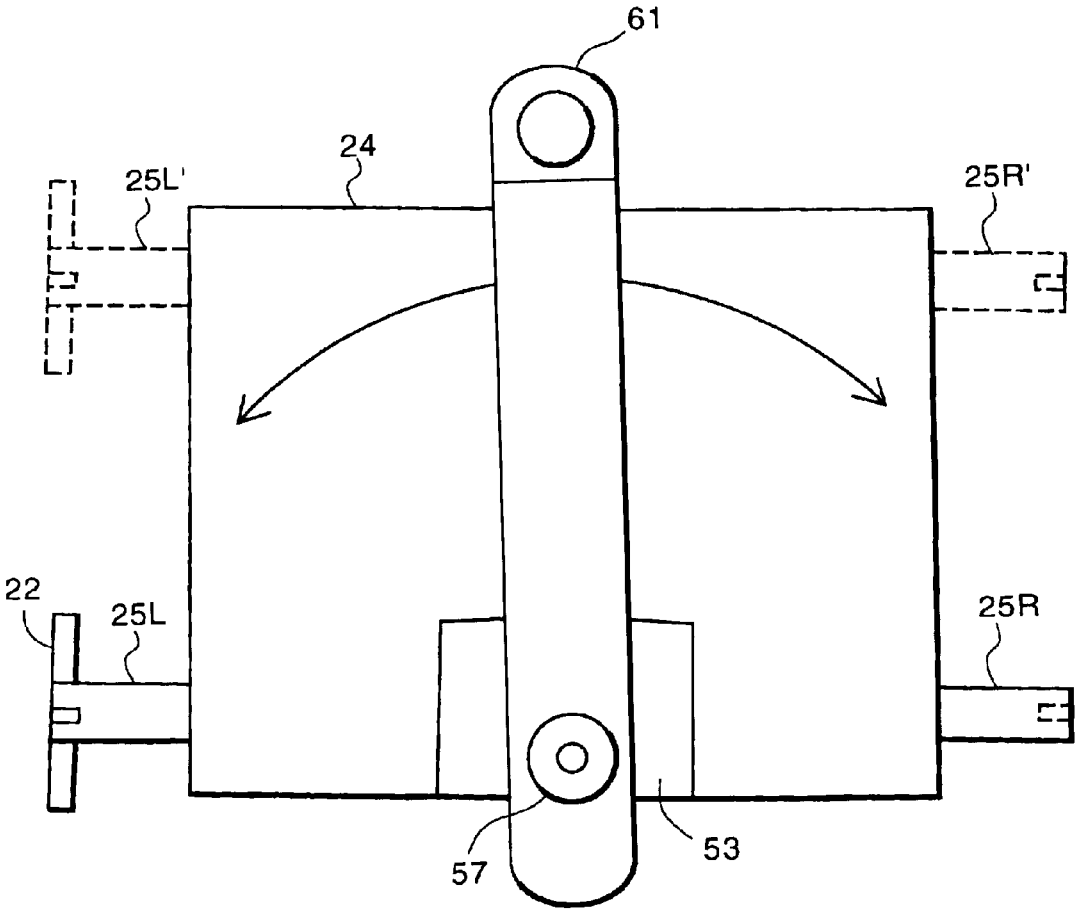
FIG. 2 is a front elevational view of one embodiment of the invention.

The level winding device of this invention 10 is mounted on a mobile platform between a cable guide 11 having a pair of roller wheels 12 and 13. The left-end of FIG. 1 is the rear of the machine. The machine travels forward and reverse. In the top view shown in FIG. 1, the cable reel 15 mounted on a shaft 16 and driven by an electric motor 17 which is coupled by sprocket chain 18 to a sprocket wheel 19 on the shaft 16 of the cable reel. A further sprocket 20 is mounted on the end of shaft 16 and has a sprocket chain 21 which is trained around a sprocket wheel 22 on the device 10 of the present invention. It will be noted that the input shaft 25 on the device of the present invention as it extends outwardly from both sides of the housing 24, as at 25L and 25R so that the input to the level winding device 10 of the present invention can be mounted for operation for left- and right-handed machines. In other words, shaft 25 is keyed for mounting sprocket wheel 22 on the right hand 25R as well as the left-hand end 25L.

Figure 3:
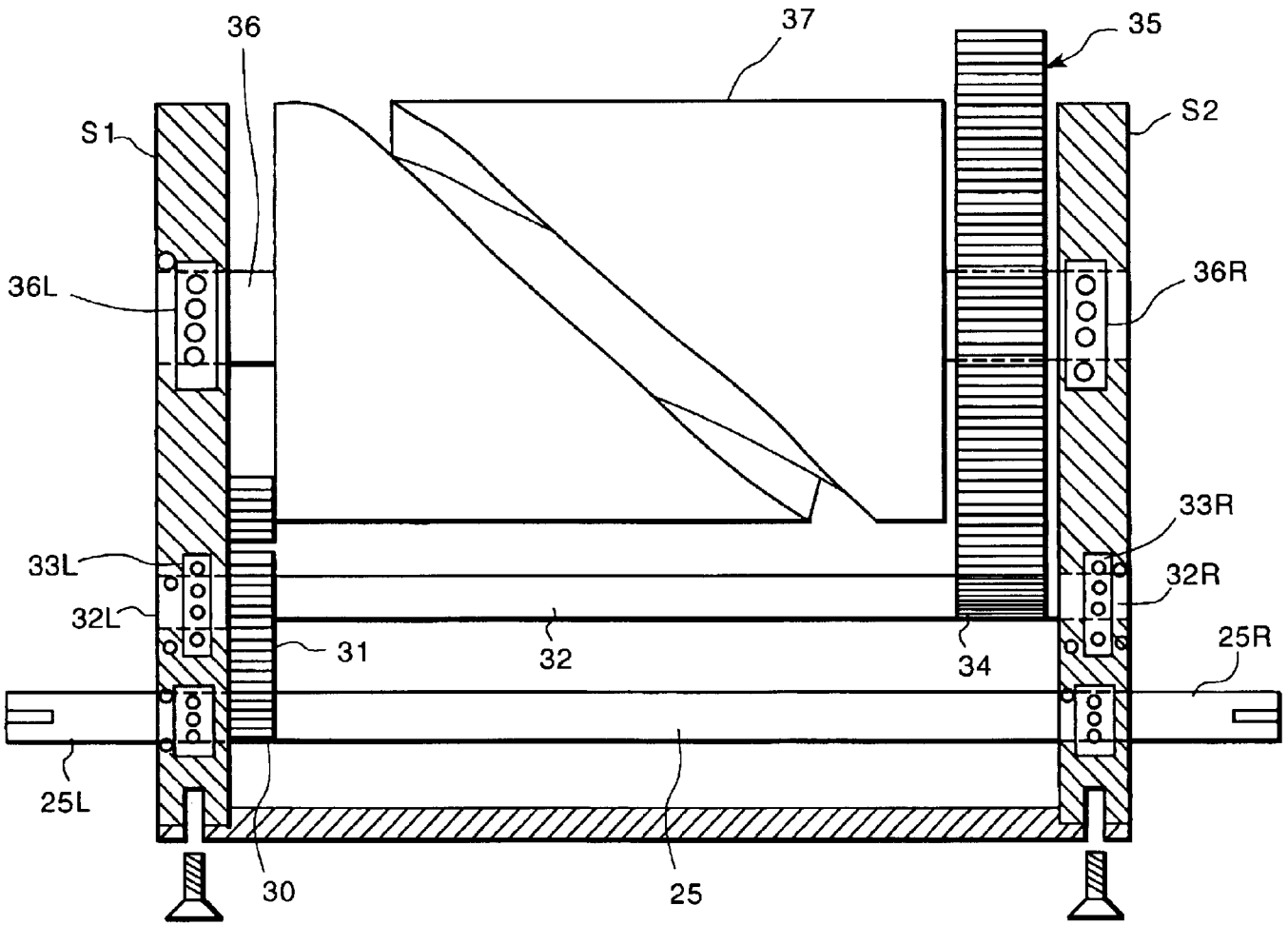
FIG. 3 is a lateral sectional view of a level winding device incorporating the invention.
Figure 4:
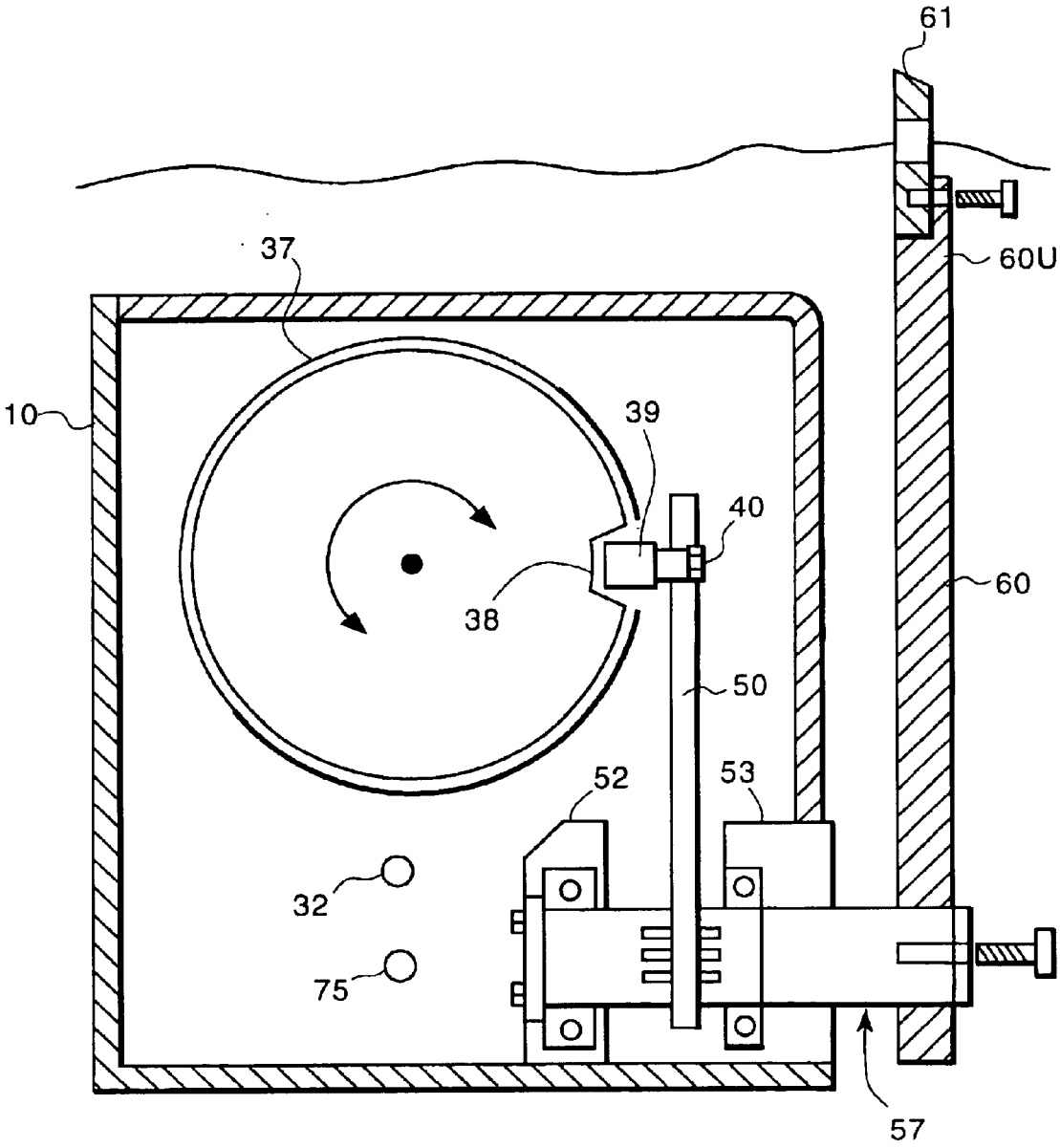
FIG. 4 is a sectional view through the oscillating arm of the level winding device incorporating the invention.

As shown in FIG. 3, input shaft 25 is mounted in side plates S1 and S2 by bearings B. Input shaft 25 has gear teeth 30 cut directly in the shaft to make the device more compact and reliable. A countergear 31 is mounted on countershaft 32 whose lateral ends 32R and 32L are mounted in journal bearings 33L and 33R in side plates S1 and S2, respectively. Countershaft or gear shaft 32 has a space-reducing gear 34 cut directly into the shaft 32. Gear 34 is meshed or engaged with spur gear 35 mounted on cam body shaft 36 which is mounted at its ends 36L and 36R mounted by bearings in side plates Si and S2, respectively.

The cam body 37 is mounted on shaft 36. When the gear input shaft 25 is rotated by the sprocket 22 (FIG. 1), the gear 30 rotates countergear 31 which rotates countergear shaft 32 and in turn rotates gear 34 cut into the shaft 32 thereby rotating gear 35 which, in turn, rotates the cam body 37. The bearings are all roller bearings and held in place by snap rings of conventional design. Cam body 37 has a single continuous cam groove 38 cut in it. Cam groove 38 receives a cam follower 39 which is a bearing mounted on a stud shaft 40 which, in turn, is mounted in the upper end of pivoted arm 50. Pivoted arm 50 is key mounted on shaft 51 which in turn is mounted in bearing brackets 52, 53 which has an outwardly extending arm 57 on which is mounted upwardly extending arm 60. Cable guide arm 60 has a cable guide 61 fastened to its upper end 60U. Bearing brackets 52 and 53 are welded to the housing.

When the cam 37 is rotated in either direction, it causes arm 50 to follow the groove 38 cut in cam body 37 via cam follower 39 that is inserted into it. Arm 50 moves back and forth, oscillating shaft 57 back and forth which moves cable guide arm 60 back and forth which causes the cable which is threaded through cable guide 61 to wind up evenly on reel or drum 15.

Thus, there has been provided an improved level winding device for heavy-duty cables, hoses and the like in which the input shaft is extended through both sides of the housing so that the device can be used on left-handed and right-handed inputs and avoids the necessity of having to inventory both types of input devices. Moreover, the cable to guide the output arm has been centered with the device, and the device has been made more compact by cutting the gear teeth in the input shaft, one of the gear teeth in the input shaft and one of the gear teeth in the countershaft, as illustrated and described above.

While the preferred embodiments of the invention have been illustrated and described, it will be appreciated that other embodiments and adaptations and changes to the invention will be readily apparent to those skilled in the art.

What is claimed is:

1. A cable reel level winding device having a housing, a first shaft mounted for rotation in said housing and having two laterally extending ends, key formations on said laterally extending ends for receiving an input drive sprocket, a first gear cut into said first shaft adjacent one side thereof, a countershaft having a countergear mounted thereon and mounted for rotation in said housing, said countergear being meshed with said first gear cut into said first shaft and rotated thereby, and a second gear cut into said countershaft, a cam body having a third shaft extending laterally outwardly for mounting in said housing, said cam body having a continuous cam groove cut therein, a spur gear mounted on said cam shaft and in meshed engagement with said second gear cut in said countershaft and rotated thereby, a cam follower in said groove and driven thereby, an arm carrying said cam follower and oscillated back and forth thereby, a fourth shaft mounted for rotation in said housing and engaged with said cam follower so as said cam follower oscillates back and forth, said fourth shaft oscillates back and forth, and a cable guide arm mounted on said fourth shaft and having a cable guide eye through which the cable passes so that when same cam is rotated in either direction, said cam causes said cam follower arm to oscillate back and forth causing said fourth shaft to oscillate back and forth thereby causing said cable guide to oscillate back and forth so that the cable passing through said eye is wound evenly on said cable reel.

2. The cable reed level winding device defined in claim 1 wherein said fourth shaft is centrally mounted in said housing.

3. A cable reel winding device for heavy duty cables comprising: a housing having first and second side plates, an input shaft journaled in said first and second side plates and having ends extending outwardly beyond said first and second side plates, said ends being adapted to receive a rotary input so that said device can be used as left-handed or right-handed input devices and avoids the necessity of having to inventory both left-handed and right-handed types cable reeling devices, a gear cut into said input shaft adjacent one side thereof, a countershaft having a countergear mounted thereon and adapted for rotation in said housing, said countergear being meshed with said gear cut into said input shaft and rotated thereby, a second gear cut into said countershaft, a cam body having a third shaft extending laterally outwardly and rotatably mounted in said pair of plates in said housing, said cam body having a continuous cam groove cut therein, a spur gear mounted on said cam shaft and in meshed engagement with said second gear cut in said countershaft and rotated thereby, a cam follower in said cam groove and driven thereby, an arm carrying said cam follower and oscillated back and forth thereby, a fourth shaft mounted for oscillatory rotation in said housing and engaged with said cam follower so that as said cam follower oscillates back and forth, said fourth shaft oscillates back and forth, and a cable guide arm mounted on said fourth shaft and having a cable guide eye through which the cable passes so that when said cam is rotated in either direction, said cam causes said cam follower arm to oscillate back and forth causing said fourth shaft to oscillate back and forth thereby causing said cable guide to oscillate back and forth so that the cable passing through said eye is wound evenly on said cable reel.

* * * * *